US008365869B2

(12) United States Patent
Stannah et al.

(10) Patent No.: US 8,365,869 B2
(45) Date of Patent: Feb. 5, 2013

(54) STAIRLIFT OBSTRUCTION MONITORING

(75) Inventors: Alan Neil Russell Stannah, Andover (GB); Nigel Titchener, Andover (GB)

(73) Assignee: Stannah Stairlifts Limited, Andover (GB)

( * ) Notice: Subject to any disclaimer, the term of this patent is extended or adjusted under 35 U.S.C. 154(b) by 303 days.

(21) Appl. No.: 12/735,696

(22) PCT Filed: Feb. 6, 2009

(86) PCT No.: PCT/GB2009/000346

§ 371 (c)(1), (2), (4) Date: Aug. 9, 2010

(87) PCT Pub. No.: WO2009/098480

PCT Pub. Date: Aug. 13, 2009

(65) Prior Publication Data

US 2010/0314201 A1 Dec. 16, 2010

(30) Foreign Application Priority Data

Feb. 9, 2008 (GB) ..... 0802457.2

(51) Int. Cl.
*B66B 9/08* (2006.01)

(52) U.S. Cl. ..... 187/202; 187/392

(58) Field of Classification Search ..... 187/201, 187/202, 277, 392; 318/366–370
See application file for complete search history.

(56) References Cited

U.S. PATENT DOCUMENTS

| | | | | |
|---|---|---|---|---|
| 5,105,914 | A * | 4/1992 | Holden | 187/201 |
| 5,387,768 | A * | 2/1995 | Izard et al. | 187/392 |
| 6,339,375 | B1 * | 1/2002 | Hirata et al. | 340/541 |
| 7,140,469 | B2 * | 11/2006 | Deplazes et al. | 187/316 |
| 7,708,117 | B2 * | 5/2010 | van der Heiden | 187/201 |
| 8,087,495 | B2 * | 1/2012 | Szentistvany | 187/202 |
| 2005/0088520 | A1 | 4/2005 | Wiesinger et al. | |
| 2007/0051562 | A1 * | 3/2007 | Titchener et al. | 187/200 |
| 2010/0274409 | A1 * | 10/2010 | Smith et al. | 700/304 |
| 2011/0088977 | A1 * | 4/2011 | Woodhams | 187/201 |

FOREIGN PATENT DOCUMENTS

| | | | |
|---|---|---|---|
| EP | 1 254 858 | | 11/2002 |
| GB | 2367808 | A * | 4/2002 |
| GB | 2435463 | A * | 8/2007 |
| JP | 59-198277 | | 11/1984 |
| JP | 60-97186 | | 5/1985 |
| JP | 2001220079 | A * | 8/2001 |
| JP | 2004307205 | A * | 11/2004 |
| WO | 2005/012153 | | 2/2005 |

OTHER PUBLICATIONS

International Search Report for PCT/GB2009/000346 mailed Apr. 17, 2009.

Written Opinion of the International Searching Authority for PCT/GB2009/000346 mailed Apr. 17, 2009.

* cited by examiner

*Primary Examiner* — Anthony Salata

(74) *Attorney, Agent, or Firm* — Nixon & Vanderhye P.C.

(57) ABSTRACT

The invention provides for a method of operating a stairlift, the stairlift having non-contact sensors to monitor the path along which the stairlift carriage is traveling, and to determine the presence of an obstruction on that path. Features of the stairlift in a 'safe' or 'un-obstructed' mode, including the path, may be stored as a 'map' in memory and sensor readings compared with the map as the carriage moves along the path. The invention allows the use of momentary commands to initiate and maintain movement of the stairlift.

19 Claims, 4 Drawing Sheets

STAIRLIFT OBSTRUCTION MONITORING

This application is the U.S. national phase of International Application No. PCT/GB2009/000346 filed 6 Feb. 2009, which designated the U.S., and claims priority to Great Britain application No. 0802457.2, filed 9 Feb. 2008, the entire contents of each of which are hereby incorporated by reference.

FIELD OF THE INVENTION

This invention relates to stairlifts and, in particular, to a method of and/or apparatus for enhancing the safety features of a stairlift installation. The term stairlift as used herein is intended to encompass all forms of stairlift, whether for a seated or standing user, or platform lifts for wheelchairs configured to operate along a staircase.

BACKGROUND TO THE INVENTION

At present stairlifts are provided with a number of features to ensure user safety. These include the hand control operated by the user, and mechanical safety edges or surfaces which are positioned so that, if the stairlift encounters an obstacle during its journey, the safety edges or surfaces are displaced and operate a safety switch to cut the supply of power to the stairlift drive motor.

Current hand controls require the user to maintain a constant pressure on the is control to effect movement of the stairlift. When moving, the stairlift may be brought to a halt in the event that either pressure on the hand control is released or a mechanical safety edge or surface comes into contact with an obstruction in the path of the stairlift.

Existing hand controls and existing safety edges each have their own shortcomings.

As far as hand controls are concerned, the direction and degree of pressure required to operate these controls often causes discomfort, and even pain.

Many stairlift users suffer from limited manual dexterity in different forms and it simply is not possible to arrive at a single form of hand control which all users will always find comfortable to operate.

A further shortcoming is that, in the event a danger is anticipated and that danger is of a type not accommodated by the mechanical safety edges, the expected reaction is for the stairlift user to release the hand control to stop the stairlift. Given the nature of those persons typically using stairlifts, it must be assumed that their reaction time will be relatively slow and, as a consequence, the anticipated danger may not, in fact, be avoided.

As regards safety edges, existing safety edges or surfaces are designed to react to an obstacle. The obstacle may, for example, be a stationary object on the staircase, or may be clothing or even a limb of a stairlift user being in a position in which it becomes trapped between the moving stairlift and a stationary surface.

Obviously the broad objective of safety edges or surfaces is to ensure that a stairlift user, or a person in close proximity to a moving stairlift, is protected against a trapping, shearing or crushing hazard and the safety edges are positioned about the stairlift carriage with that objective in mind.

A first problem with existing safety edges is that such edges are typically included in displaceable pads positioned about the lower edges of the carriage and about the edges of the footrest. Other potential sources for trapping, crushing and/or shearing exist but these are not addressed as the existing pads are cumbersome and do not lend themselves to positioning elsewhere on the carriage and/or chair.

A second problem is that the safety edges or surfaces are reactive in that they only operate to stop the stairlift once the stairlift has, through one of the safety edges, engaged the obstruction. Standards governing the design of stairlifts require that, in the event the moving carriage encounters an obstruction while moving, the stairlift carriage be brought to a halt within a defined distance (currently 20 mm). Clearly a part of this defined distance will be taken up by the displacement of the edge or surface itself before the cut-out switch operates and the stairlift comes to a halt.

A third problem is that safety edges and the switches which they operate, occupy significant space. This runs counter to the objective of ensuring that the stairlift installation is as compact as possible and occupies as little space as is possible. Further, the resulting safety edge configuration invariably detracts from the aesthetics of the stairlift installation.

The fact that both existing hand controls and safety edges are reactive in bringing a stairlift to a halt, has an adverse effect on the speed at which a stairlift can operate, and thus the installation may fail to meet users' expectations or requirements. Current regulations in force in the UK limit the maximum speed of a stairlift to 0.15 m/sec. A significant reason underlying this limit is the need to halt the stairlift within the 20 mm defined distance mentioned above and, even at this speed, bringing the stairlift to a halt within 20 mm of engaging an obstruction can cause an uncomfortable and even alarming jolt.

It is an object of this invention to provide a method of and/or means for controlling the operation of a stairlift which will go at least someway in addressing the aforementioned problems; or which will at least provide a novel and useful choice.

SUMMARY OF THE INVENTION

In a first aspect the invention provides a method of controlling the operation of a stairlift traveling along a defined path, said method including the steps of causing said stairlift to commence moving; monitoring said path ahead of the moving stairlift; and, in the event the monitoring step identifies an obstruction in said path, causing the stairlift to halt before the stairlift comes into contact with said obstruction.

Preferably said method further includes monitoring for an obstruction on said path before allowing said stairlift to commence moving along said path.

Preferably said method includes causing said stairlift to move by a momentary command. Said command may be imposed physically or verbally; or may be at least partly inferred.

Preferably the step of monitoring said path includes defining a zone of known characteristics around said stairlift; and interrogating said zone for changes in one or more of said characteristics.

Preferably said zone is defined according to the position of said stairlift along said defined path.

Preferably data representing safe characteristics, at various positions of said stairlift along said path, are stored in memory, the step of monitoring said path comprising comparing, as said stairlift moves along said path, said characteristics with corresponding data stored in said memory.

Preferably said method further includes causing an alarm to be generated in the event an obstruction on said path is sensed.

Preferably said method further includes sensing if a user is about to mount or dis-mount the stairlift; and preventing movement of the stairlift in the event either action is sensed.

Preferably said method is applied to the control of the speed of said stairlift along said defined path.

In a second aspect the invention provides a stairlift including a stairlift carriage and a defined path along which, in use, the carriage travels, said stairlift including a start control to initiate movement of said carriage along said path and being characterized in that it further includes a monitoring facility operable to monitor said path ahead of the moving carriage and, in the event the monitoring step identifies an obstruction in said path, to cause the carriage to halt before the carriage comes into contact with said obstruction.

Preferably said monitoring facility is further operable to monitor for an obstruction on said path before said start control can become active.

Preferably said start control comprises a momentary control. Said momentary control may be activated physically or verbally; or may be at least partly inferred from pre-determined states of the stairlift.

Preferably said monitoring facility is operable to monitor a zone of known characteristics around said carriage. One or more of the characteristics in said zone may vary according to the position of said carriage along said defined path.

Preferably data representing safe characteristics, at various positions of said carriage along said path, are stored in an electronic memory, said monitoring facility being operable to compare, as said carriage moves along said path, said characteristics with the data stored in memory.

Preferably said monitoring facility is further operable to cause an alarm to be generated in the event an obstruction on said path is sensed.

Preferably said monitoring facility includes one or more obstruction detection sensors.

Preferably said one or more obstruction detection sensors have variable sensitivity.

Preferably at least one said obstruction detection sensor has a sensitivity which varies relative to the speed of said carriage.

Preferably said one or more obstruction detection sensors are mounted on said carriage and/or on a chair mounted on said carriage. Said obstruction detection sensors may also be arranged along said defined path including on a rail defining said path.

Preferably said one or more obstruction detection sensors comprise capacitive, eddy current, inductive, photo-electric, opto-electric, ultrasonic-based, Hall effect, radar-based or laser-based sensors; or a combination of one or more of such sensors.

Said monitoring facility may also include optical and/or video signal capture and/or digital camera recognition.

In a third aspect the invention provides a method of controlling the speed of a stairlift carriage along a defined path on which an obstruction may be present, said method being characterized in that it does not depend on the need to react to said carriage coming into contact with an obstruction.

Preferably said method includes monitoring said path to detect the presence of an obstruction and controlling said speed to ensure said carriage does not contact said obstruction.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

One preferred form of the invention will now be described with reference to the accompanying drawings in which.

DETAILED DESCRIPTION OF WORKING EMBODIMENT

The invention provides a stairlift and/or a method of operating a stairlift. The broad objective of the installation is to address the inherent drawbacks of existing hand controls and/or contact displaceable safety edges or surfaces, whilst maintaining or even enhancing the safety of a stairlift user.

Figure 1:
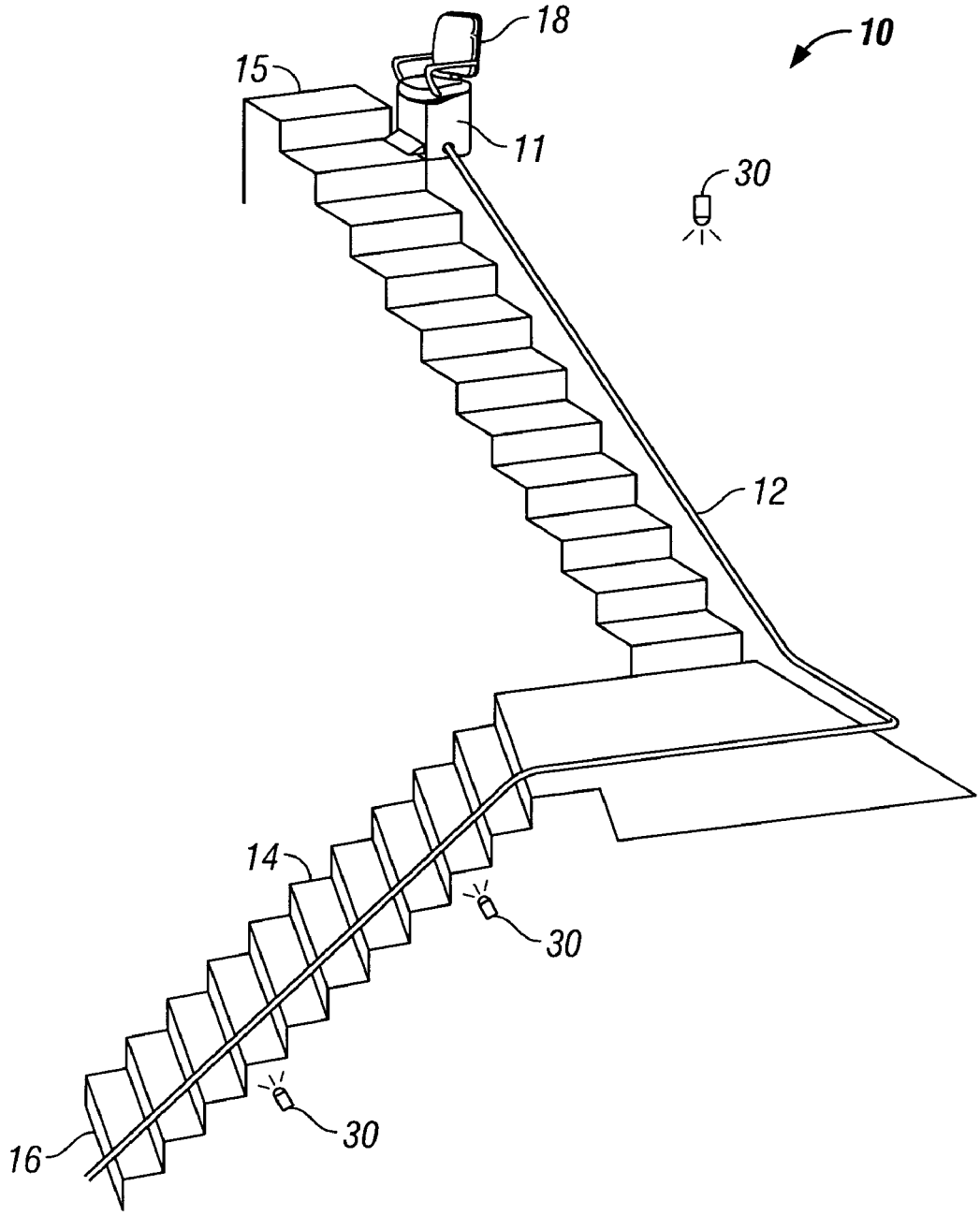
FIG. 1: shows an isometric view of a stairlift installation to which the present invention may be applied.
Figure 2:
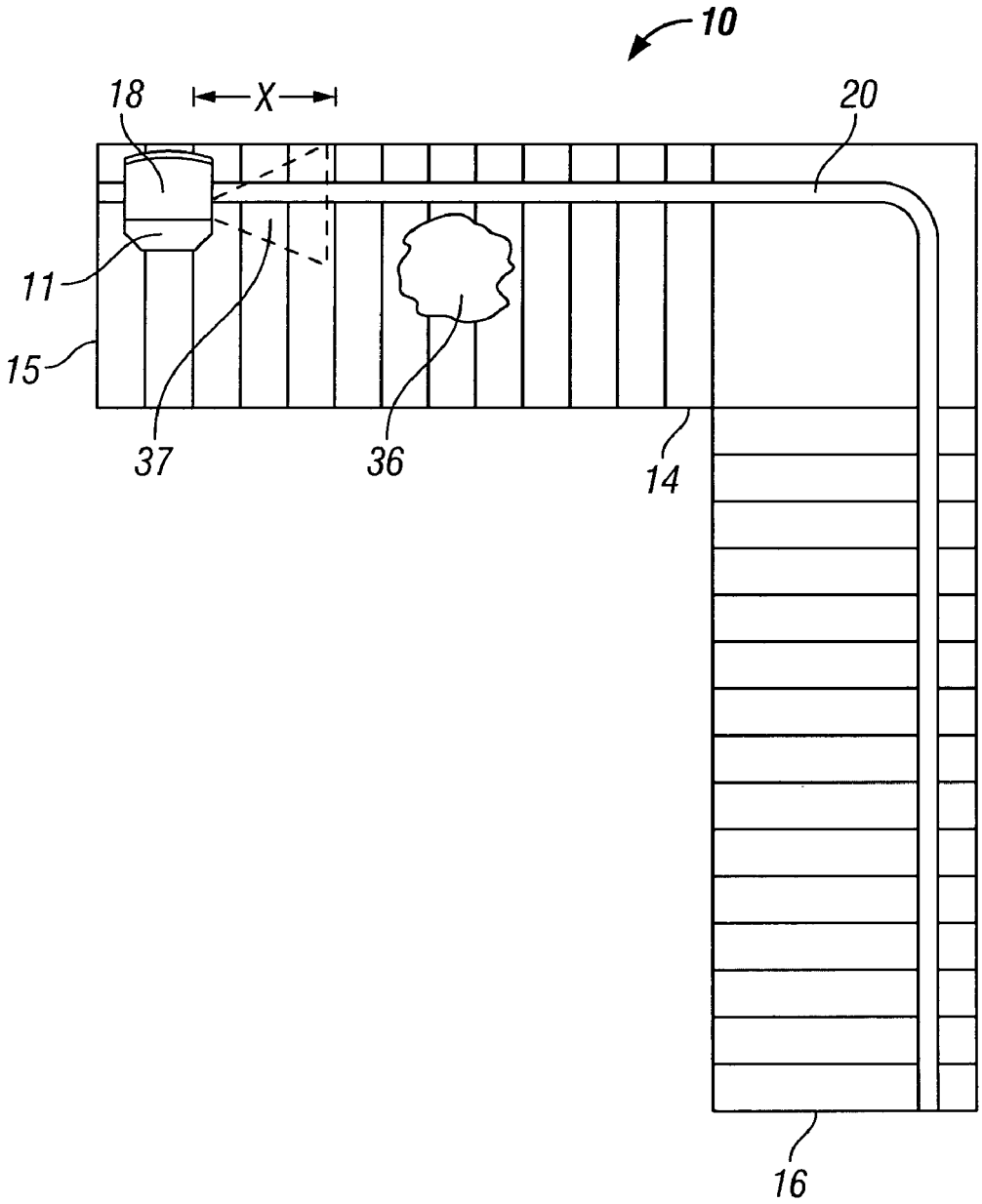
FIG. 2: shows a plan view of that which is shown in FIG. 1.

Referring to FIGS. 1 & 2, a stairlift installation 10 includes a carriage 11 moveable along a defined path. Typically the path is defined by a rail 12 mounted on a staircase 14, the staircase 14 having an upper end 15 and a lower end 16. In the conventional manner the carriage 11 has a chair 18 mounted thereon, which chair is, in use, occupied by a user. As can be seen most clearly in FIGS. 3 & 4, the chair 18 has seat base 19, a back 20, armrests 21 and a footrest 22.

Figure 3:
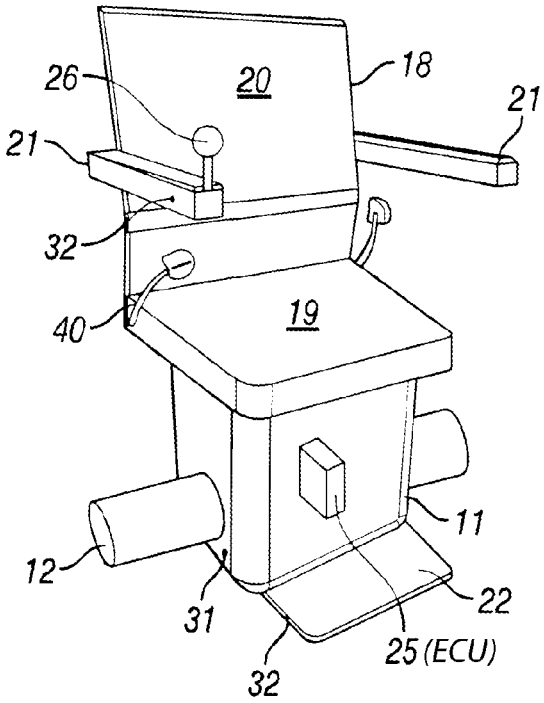
FIG. 3: shows an isometric view of a stairlift carriage and chair forming part of an installation according to the invention.
Figure 4:
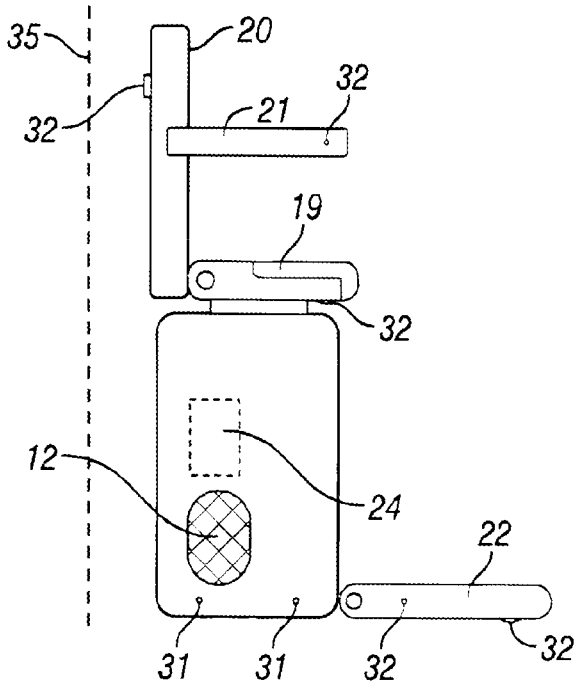
FIG. 4: shows an end elevation of that which is shown in FIG. 3.

Provided within the carriage 11 is a drive motor 24, indicated in dotted outline in FIG. 4 and an electronic control unit (ECU) 25 which is shown schematically in FIG. 3. The stairlift preferably further includes a start control, indicated at 26 in FIG. 3, although alternatives to such a control will be discussed below.

In accordance with the invention the path broadly defined by rail 12 is monitored for obstructions ahead of the moving carriage. In the event the presence of an obstruction is sensed, the carriage is decelerated and, in the event the obstruction remains, the carriage is brought to a halt before the carriage comes into contact therewith. Indeed the monitoring facility preferably operates as soon as a command is received by the ECU to initiate movement of the carriage, the monitoring facility preventing movement if the presence of an obstruction is sensed.

As will be apparent from the description which follows, the monitoring facility is provided in part within the ECU 25 or a further ECU operating on conjunction therewith. The monitoring facility further includes one or more obstruction detection sensors which are positioned and configured to monitor the path ahead of the moving carriage and, preferably, a zone around the carnage which includes the immediate path ahead of the carriage 11.

The obstruction detection sensors may be mounted on various parts of the staircase as shown at 30 in FIG. 1, and also on the rail 12. Such sensors may include optical or video cameras. However, in the particular embodiment described herein, and shown in FIGS. 3 and 4, the sensors are mounted on the carriage 11 and the chair 18. To this end, sensors 31 are preferably mounted on the lower end faces of the carriage adjacent the surface of rail 12. Further sensors 32 may be mounted on the footrest 22 and possibly on the armrests 21 and seat back 20. Placement of one or more sensors 32 on the seat back 20 is is particularly useful for detecting objects causing an obstruction between the chair and the wall 35 of the staircase adjacent to which the stairlift is mounted. In the past it has not been possible to detect the presence of an obstruction in this area using the existing displacement-based safety edges.

The precise type and placement of the sensors is not critical to the performance of the invention and sensors may be selected and placed in any position which allows a potential trapping, shearing or crushing site to be monitored.

The sensors 31 and 32 are non-contact sensors of any suitable type, examples of which are capacitive, eddy current, inductive, photoelectric, ultrasonic and Hall effect. Optoelectronic sensors could include laser-based sensors, photo-electronic proximity sensors, photo-electronic energetic sensors, and infra red detectors. Other monitoring possibilities could include radar sensing (including ultra wide band), ultrasonic proximity sensing and real-time imaging via analogue video capture and/or digital camera recognition. It will be appreciated that an overall monitoring facility might include a combination of one or more of the techniques, including those listed above.

The sensors are preferably selected, configured and positioned to define an operating zone around the carriage 11 such as is indicated by the triangular zone 37 shown in dotted outline in FIG. 2. In this way the distance from the carriage at which the safety systems will operate can be controlled. As an example, the operational distance of the sensors 31 and 32 is preferably limited to a distance indicated by x in FIG. 2. This is so that when the presence of an obstruction 36 is sensed, the user will know that the carriage 11 is decelerating and stopping due to the presence of the obstruction 36, and not for some other, unknown reason. For sensors aligned in the general direction of the rail 12, operational distance x may, for example, be 100 mm. For sensors monitoring from the underside of the footrest 21 or the rear of the seat back 20, the operational distance may be somewhat less and, by way of example only, could be 25 mm.

The sensors 31 and 32 are preferably connected into the main electronic control unit ECU 25 of the stairlift. As will be described in greater detail below, when the sensor senses the presence of an obstruction, the signal is received by the ECU and the appropriate command generated to decelerate the carriage and, if necessary, to bring the carriage to a halt before the carriage comes into contact with the obstruction.

Whilst the system of sensors could be purely reactive and simply operate to indicate the presence of an obstruction, it will be appreciated that the sensors 31 and 32 may, because of operational distance and/or alignment, indicate the presence of an obstruction when, in fact, no such obstruction is present. For example, as the carriage nears a bend in the rail, a sensor may sense a section of the rail itself and interpret this as the presence of an obstruction. With this in mind, another aspect of the invention comprises recording and storing in an electronic memory, 'safe' characterizing features of the environment in which the stairlift operates. These characterizing features are preferably recorded at various positions of the carriage along the rail so that a safe 'map' is obtained of the environment surrounding the stairlift installation. The characterizing features are conveniently obtained by recording electronic data received from the sensors 30, 31 and 32. With this data stored in memory, as the carriage subsequently moves up an down the rail, data obtained in real time from the sensors 30, 31 and 32 can be compared with the data in memory at the corresponding positions of the carriage along the rail. If the readings differ to a pre-determined extent, the presence of an obstruction is assumed and an alarm is generated. If the difference in readings persists the speed can be reduced until the carriage is brought to a halt smoothly, without contacting the obstruction, and without exposing the user to an unpleasant or alarming jolt.

It will be appreciated that the 'map' data is preferably stored in a non-volatile electronic memory and the position of the carriage on the rail may conveniently be determined using an encoder on the drive motor.

The contents of the electronic memory can be established at time of installation of the stairlift by placing the sensor facility in 'learn' mode and driving the carriage up and down the rail while the installation is known to be 'safe' or 'obstruction-free'. This is indicated diagrammatically by the dotted line in FIG. 5. Alternatively, when surveying the staircase for the stairlift installation, a photo-based system could be used to capture the staircase and its surroundings. This information could then be combined with the rail design to create the sensor operating limits or 'map'. The 'map' data could be generated and entered by a variety of other techniques including the entering of base data during manufacture at the factory followed by the entering of more specific or finite data during installation.

Whether the sensors are purely reactive or combined with a memory system as described above, the sensors are preferably of a type which has variable or adjustable sensitivity. Thus the sensitivity of the individual sensors can be set at different levels at various positions of the carriage 11 along the rail 12 so that the monitoring performance is at an optimum while reducing the likelihood of false readings or alarms. Further at least one of the sensors, and preferably all those sensing in the path of the carriage when it is moving both up and down the staircase, have sensitivities related to the speed of the carriage. In other words, the higher the speed of the carriage, the greater the distance 'x'. This means that braking distances can be increased as carriage speed increases thus ensuring that, in the event an obstruction is encountered, the carriage can always be brought to a halt in a manner which does not subject the user to alarm or discomfort.

To ensure safety is maintained at all times, the monitoring facility preferably includes a checking facility so that sensor operation can be checked and an alarm or fault indication generated in the event of a sensor failure being detected.

Figure 5:
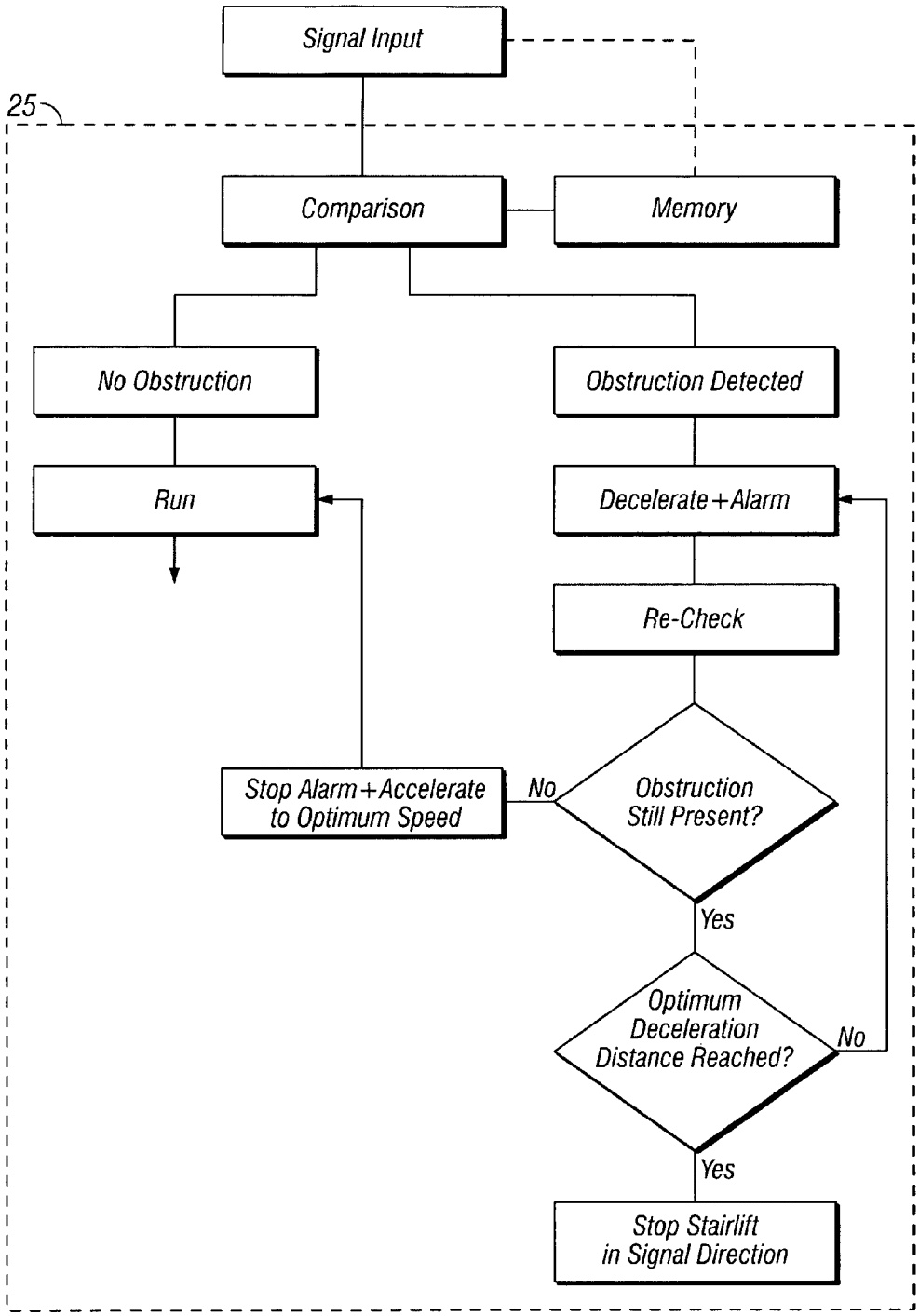
FIG. 5: shows an diagram for the inventive aspects of a stairlift installation incorporating the invention.

Turning now to FIG. 5, as the carriage 11 moves along the rail 12, the sensors 30, 31 and 32 are creating electronic signals in response to their surroundings. These signals are sent to a comparison device where the signals are compared, in real time, with the 'mapped' signals stored in electronic memory representing a safe or un-obstructed state. If no discernable or significant difference is detected between the signals noted in real time, and those stored in memory, the stairlift is allowed to run normally and at a maximum speed. If, however, the comparison step highlights a pre-determined significant difference between a real time signal and the corresponding signal stored in memory, then an obstruction in assumed to be present. In this event a command is generated by the ECU to decelerate the carriage. This deceleration is preferably accompanied by an audio and/or visual alarm signal to indicate to the user that an obstruction has been encountered. Should the obstruction be another person in the vicinity of the moving carriage, the alarm signal may cause that person to move, in which event the sensor readings may return to 'normal' and this allow the carriage to accelerate back up to operating speed. If, however, sensor signal strength indicates that the obstruction is not moving, the control system will cause the carriage to be decelerated to a halt. The operational distance and rate of deceleration are preferably coordinated so that the carriage is decelerated at a rate which is comfortable to the user yet ensures that the carriage is brought to a halt before contacting the obstruction.

For so long as one of the sensors is indicating the presence of an obstruction, the carriage may only be driven in a direction which moves it away from the obstruction.

Modifications of the invention may also be applied to sections of the stairlift which have not, previously, been possible to protect from trapping, shearing or crushing hazards. For example, in those stairlift installations that include a chair which pivots with respect to the carriage as the carriage traverses a transition bend, one or more sensors 32 could be mounted on the underside of the chair. The readings from these sensors could be combined in memory with readings from a chair rotation encoder to provide a further 'map' and thus allow trapping hazards between the chair and the carriage to be anticipated as the carriage moves through the transition bend.

A significant advantage of the monitoring facility is that it obviates the need for user intervention in order to drive the stairlift along the rail, but without sacrificing safety. Because all aspects of surroundings and safety are continuously monitored, the only intervention required by a user is to initiate movement of the stairlift. Thereafter, control of the movement can be safely and efficiently left to the ECU 25 and associated monitoring facility. Movement may be initiated by the user by a momentary (one-off) physical command. Given the nature of the start control 26 shown in FIG. 3, and typical landing call switches (not shown), this command could be effected simply by displacing the control 26 or call switch. The control 26 could be replaced by a voice-activated control where the user simply mounted the chair 18 and said 'GO'. As a further alternative, a start command might be at least partly inferred following a user mounting the chair 18 (confirmed by a seat load sensor) and connecting seat belt 40. Once the ECU had received signals both of occupation of the chair and of connection of the belt 40, the ECU could infer that a user was present and wished to travel away from the current position of the stairlift. The ECU could then energize the drive motor 24 accordingly.

It also follows that the monitoring arrangement described above provides the possibility of substantially increased speed without detracting from user safety and comfort. Because the stairlift now has a facility to ensure the carriage does not come into contact with an obstruction, speeds can be increased and deceleration rates established that ensure traveling and stopping is achieved with optimum satisfaction and comfort.

It will thus be appreciated that the present invention, at least in the case of the working embodiment described above, maintains or enhances stairlift safety and user satisfaction whilst reducing complexity, manufacturing costs, the adverse effect on installation aesthetics, and user operating discomfort.

The invention claimed is:

1. A method of controlling the operation of a stairlift carriage traveling along a defined path, said method including the steps of causing said carriage to commence moving, monitoring said path ahead of the moving carriage and, in the event an obstruction is sensed ahead of the moving carriage, causing the stairlift to halt before the stairlift comes into contact with said obstruction, wherein the monitoring step includes comparing characteristics observed as said carriage moves along said path with data representing corresponding safe characteristics stored in an electronic memory.

2. A method as claimed in claim 1 further including monitoring for an obstruction on said path before allowing said stairlift to commence moving along said path.

3. A method as claimed in claim 1 including causing said stairlift to move by a momentary command.

4. A method as claimed in claim 3 wherein said command is imposed physically or verbally; or is at least partly inferred from the activity of a user of said stairlift.

5. A method as claimed in claim 1 further including causing an alarm to be generated in the event an obstruction on said path is sensed.

6. A method as claimed in claim 1 further including sensing if a user is about to mount or dis-mount the stairlift; and preventing movement of the carriage in the event either action is sensed.

7. A method as claimed in claim 1 when applied to the control of speed of said carriage along said defined path.

8. A stairlift including a stairlift carriage and a defined path along which, in use, the carriage travels, said stairlift including a start control to initiate movement of said carriage along said path and a monitoring facility operable to monitor said path ahead of the moving carriage and, in the event the monitoring facility identifies an obstruction in said path, to cause the carriage to halt before the carriage comes into contact with said obstruction, wherein said monitoring facility includes an electronic memory containing data representing safe operating characteristics, at various positions of said carriage along said path, said monitoring facility being operable to compare, as said carriage moves along said path, characteristics observed with corresponding said safe operating characteristics.

9. A stairlift as claimed in claim 8 wherein said monitoring facility is further operable to monitor for an obstruction on said path before said start control can become active.

10. A stairlift as claimed in claim 8 wherein said start control comprises a momentary control.

11. A stairlift as claimed in claim 10 wherein said momentary control is configured for physical or verbal actuation; or is configured to actuate at least partly from inference according to activity of a user of the stairlift.

12. A stairlift as claimed in claim 8 wherein said monitoring facility is further operable to cause an alarm to be generated in the event an obstruction on said path is sensed.

13. A stairlift as claimed in claim 8 wherein said monitoring facility includes one or more obstruction detection sensors.

14. A stairlift as claimed in claim 13 wherein said one or more obstruction detection sensors have variable sensitivity.

15. A stairlift as claimed in claim 13 wherein at least one said obstruction detection sensor has a sensitivity which varies relative to the speed of said carriage.

16. A stairlift as claimed in claim 13 wherein said one or more obstruction detection sensors are mounted on said carriage and/or on a chair mounted on said carriage.

17. A stairlift as claimed in claim 13 wherein said one or more obstruction detection sensors are arranged along said defined path including on a rail defining said path.

18. A stairlift as claimed in claim 13 wherein said one or more obstruction detection sensors comprise capacitive, eddy current, inductive, photo-electric, opto-electric, ultrasonic-based, Hall effect, ultrasonic proximity, radar-based or laser based sensors; or a combination of one or more of such sensors.

19. A stairlift as claimed in claim 8 wherein said monitoring facility includes optical and/or video signal capture and/or digital camera recognition.

* * * * *